US007444939B2

(12) United States Patent
McNulty et al.

(10) Patent No.: US 7,444,939 B2
(45) Date of Patent: Nov. 4, 2008

(54) AMMUNITION FOR ELECTRICAL DISCHARGE WEAPON

(75) Inventors: James F. McNulty, Calimesa, CA (US); John A. Hultman, Casper, WY (US)

(73) Assignee: Defense Technology Corporation of America, Casper, WY (US)

( * ) Notice: Subject to any disclaimer, the term of this patent is extended or adjusted under 35 U.S.C. 154(b) by 491 days.

(21) Appl. No.: 11/083,435

(22) Filed: Mar. 17, 2005

(65) Prior Publication Data

US 2006/0207466 A1 Sep. 21, 2006

(51) Int. Cl.
*F41B 15/04* (2006.01)
*F41C 9/00* (2006.01)

(52) U.S. Cl. ..... 102/502; 361/232; 42/1.08

(58) Field of Classification Search ..... 102/502, 102/504; 361/232; 42/1.08, 84
See application file for complete search history.

(56) References Cited

U.S. PATENT DOCUMENTS 4,253,132 A * 2/1981 Cover ..... 361/232
5,078,117 A 1/1992 Cover
5,654,867 A 8/1997 Murray
5,771,663 A 6/1998 Wold et al.
6,360,645 B1 * 3/2002 McNulty et al. ..... 89/1.11
6,575,073 B2 * 6/2003 McNulty et al. ..... 89/1.11
2005/0024807 A1 * 2/2005 Cerovic et al. ..... 361/232
2005/0109200 A1 * 5/2005 McNulty, Jr. ..... 89/1.11
2006/0120009 A1 * 6/2006 Chudy, II ..... 361/232
2006/0187610 A1 * 8/2006 Su ..... 361/232
2007/0019358 A1 * 1/2007 Kroll ..... 361/232

* cited by examiner

*Primary Examiner*—James S Bergin
(74) *Attorney, Agent, or Firm*—Christie, Parker & Hale, LLP

(57) ABSTRACT

A primer-fired ammunition cartridge for an electrical discharge weapon having a housing with an exterior surface and two wire-tethered darts positioned within dart chambers in the housing and two electrical contacts positioned on opposite surfaces of the housing for lengthening an electrical arc path across the exterior surface of the housing. The housing can include a flange portion for engaging a chamber in an electrical discharge weapon wherein the flange portion includes an aperture thereby allowing the flange portion to bow and absorb resultant forces between the ammunition cartridge and the chamber of the electrical discharge weapon during firing of the cartridge.

6 Claims, 2 Drawing Sheets

AMMUNITION FOR ELECTRICAL DISCHARGE WEAPON

BACKGROUND OF THE INVENTION

The present invention relates generally to the field of electrical immobilization weapons of the type which impart an electrical impulse to immobilize a human target by inducing involuntary muscular contractions, and more particularly, to an improved ammunition cartridge for the electrical discharge weapon which provides for a longer arc path at the target by lengthening potential arc paths across the exterior surfaces of the ammunition cartridge, while still maintaining a conveniently small size for use and storage. Electrical discharge weapons, commonly sold under the trademark TASER, are weapons that connect a human target to a remote electrical power supply by means of a pair of darts and trailing conductors, so that the human target can be disabled by an electrical shock from the weapon. The typical power supply of an electrical discharge weapon produces low amperage shocks of 50 KV. Human beings can be disabled by shocks of much lower voltage, however, the higher voltage is needed to ionize air paths, so electrical currents can penetrate otherwise insulated garments worn by the human target to complete the shocking circuit through the body. 50 KV from a typical electrical discharge weapon will arc across an air gap of approximately two inches.

Typical ammunition cartridges for electrical discharge weapons launch their darts by the force of explosion of a chemical propellant (primer fired), or by force resulting from the release of compressed gas or spring tension. Previous primer fired ammunition cartridges are substantially rectangular in shape, and formed of a high impact plastic housing and include wire chambers positioned adjacent interior walls of the housing. The chambers open at an exit surface and are positioned at an angle with respect to each other within the cartridge housing.

When the power supply for the weapon is energized, electrical current travels from a power supply electrode to the primer and sparks through the propellant where it arcs therefrom to the conductor in the wire chamber. The current then travels through the conductor to the attached dart assembly and arcs therefrom across the exit surface to the second dart assembly. The current continues to travel through its attached conductor to an opposed electrode of the power supply, or vice versa, depending on the polarity of the supply transformer poles. The propellant contained in the primer detonates and launches the darts from the cartridge. The darts separate from each other in angled flight, and open the detonation circuit as its current can no longer complete an arc path between the darts. If the darts come within arcing distance of a human target, the shocking circuit will complete through and disable the target.

A problem with primer fired ammunition cartridges is that the shocking current will arc through the shortest available air gap. Based upon the design of currently available primer fired ammunition cartridges, the shortest distance is between the primer exposed on the rear surface of the housing, and an adjacent side surface of the housing. Therefore, the maximum total distance that current might arc from the darts seated in garment clothing on the human target must be less than the distance between the primer located on the back surface of the cartridge, and a termination positioned on the side surface of the cartridge. If the distance between the target's clothing is greater than this distance, the shocking current will not arc through the target, and therefore, the darts will not subdue the target.

Additionally, the circuit might arc even a shorter distance at the target because of the phenomenon known as arc tracking, particularly if prior usage of the weapon has fouled the ammunition chamber with conductive carbon residues. Accordingly, if a human target is wearing clothing that is further distant from the body, then the arc path of the ammunition cartridge, the target will not be shocked or disabled even if both darts contact their clothing while the weapon is energized. For example, a human target might not be disabled if one dart impaled into his or her shirt over the chest while the other dart impaled into his or her shirt lapel or loose hanging pants fabric, or if both darts landed in a thick jacket or coat. Consequently, a need exists to extend or lengthen the arc path on the ammunition cartridge so that the arc is available at the target to penetrate clothing based upon a 50 KV power source.

A second problem associated with previous primer fired ammunition cartridges is that over a period of time the receiving port of the weapon can become damaged due to the explosive forces of firing the ammunition. Typical primer fired cartridges include a cantilever which seats into a conforming depression in the plane of one of the port walls of the weapon to lock the cartridge into the receiver of the weapon during firing. When the charge in the ammunition cartridge is detonated, resultant forces cause the cantilever to move forward and collide with the corresponding wall of the depression, and therefore the cartridge is restrained within the receiver. With time and exposure to the elements, the structural integrity of the weapon can become compromised, and as the sides of the cartridges cantilever repeatedly strikes against the corresponding wall of the seating depression in the wall of the receiver port, the receiver's plastic can fracture and chip off. If enough plastic dislodges from the wall, resultant forces might fire the entire cartridge out of the weapon after the cartridge's charge is detonated. This disconnects the darts from the weapons power supply, and the remote target will not be shocked thereafter. Consequently, a need exists for an improved design which will prevent the ammunition cartridge from being ejected from the weapon after repeated use.

SUMMARY OF THE INVENTION

The present invention is directed to an improved primer fired ammunition cartridge for an electrical discharge weapon which allows for a longer arc path at the target by lengthening potential arc paths across the exterior surfaces of the ammunition cartridge, while still maintaining a cartridge that is conveniently small for use and storage. The improved ammunition cartridge includes electrical contacts positioned on opposed side surfaces of a substantially rectangular housing. Ideally, each contact can be positioned approximately half way between the front and rear surfaces of the housing to avoid arc breakdowns between an exposed contact and a stored conductor. The conductor is then routed from one contact to about the nearest point of the portion of the primer case exposed on the exterior rear surface of the housing.

A plate covers the rear surface opposing the front surface. The plate does not have an aperture either over or about the primer. The plate surface facing the primer includes ridges or other areas of relief or bends to increase the arc tracking path, and is cemented to the rear surface with an epoxy or ABS cement having a dielectric strength of about 500 to 800 volts per mil. A plug raised on the plate surface seats over and secures the primer which is recessed into the housing to increase the arc track path. The plug also prevents blowback which is a loss of propulsive forces as gas escapes from the back of the primer after detonation. Contact probes extend in the cartridge to the front surface to be used as back up if the cartridge firing should fail to subdue a violent suspect.

A primer fired cartridge also can contain a recess or aperature in a flanged portion to absorb energy to reduce damage to the receiver port in the weapon. A rod also can be positioned in the receiver port to engage the aperature in the flange to prevent the cartridge from being ejected out of the weapon.

DETAILED DESCRIPTION OF THE INVENTION

Figure 1:
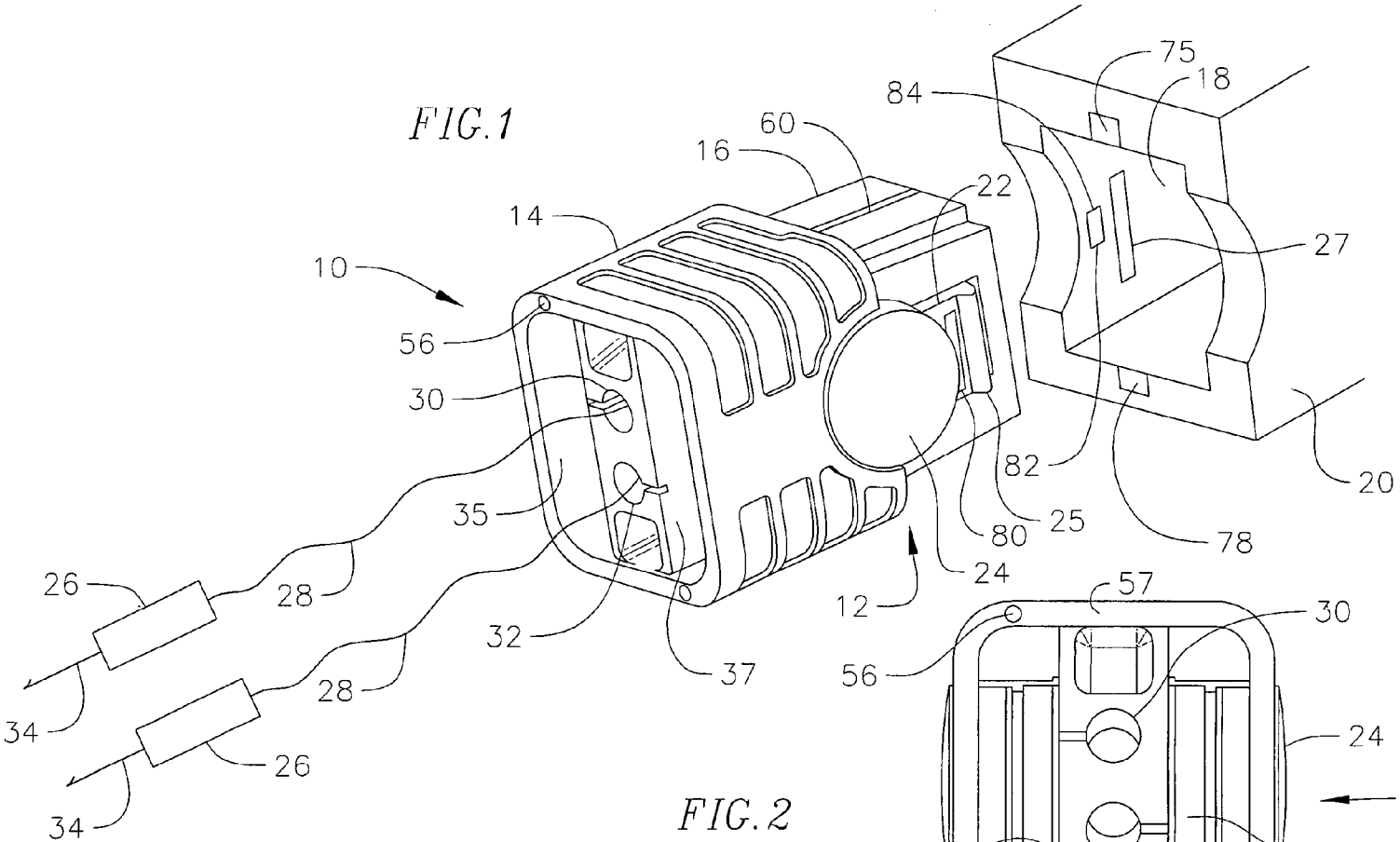
FIG. 1 is a perspective view of an ammunition cartridge of the present invention.
Figure 2:
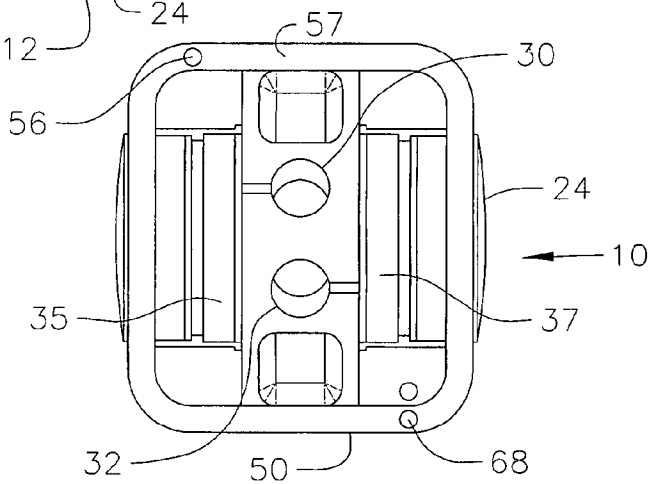
FIG. 2 is a front view of the cartridge of FIG. 1.
Figure 3:
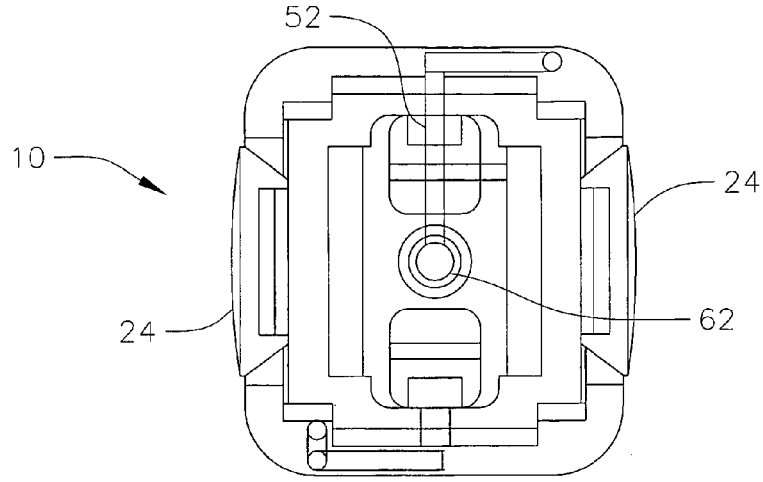
FIG. 3 is a rear view of the cartridge of FIG. 1.
Figure 4:
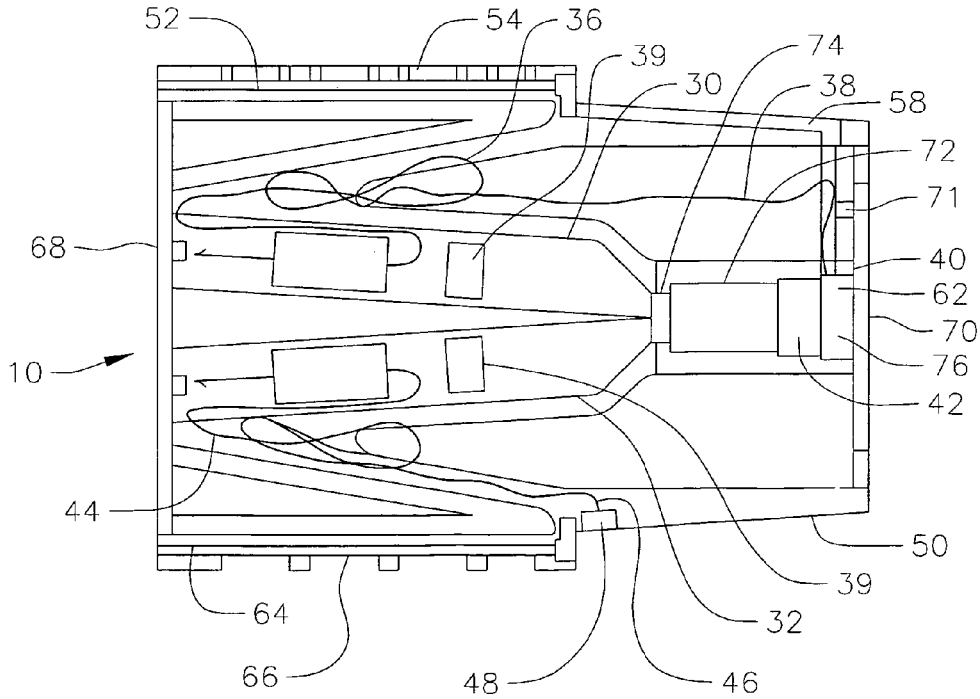
FIG. 4 is a cross-sectional view of the cartridge of FIG. 1.

Referring to FIGS. 1 through 4, an ammunition cartridge 10 of the present invention is illustrated. The cartridge has a housing 12 formed of high impact plastic having a forward section 14, and a rear section 16. Rear section 16 is received within a cavity or receiver port 18 of an electrical discharge weapon 20. Flexible flanges 22 extend along each side of the housing, and include a boss 24 to flex the flange during insertion and removal of the cartridge from the cavity 18. The flange includes a raised stop 25 for receipt into a recess 27 in port 18 to retain the cartridge in the weapon. Dart 26 and wire assemblies 28 are positioned within dart chambers 30 and 32 contained within the housing 12. Dart chambers 30 and 32 extend into the housing at an angle so that the darts when propelled from the housing separate from one another in flight. Darts 26 each include a barbed hook 34. The wire assemblies 28 include a span of insulated conductor which is wound 36 and positioned within wire storage chambers 35 and 37 adjacent the dart chambers. Wads 39 are positioned behind the darts in the dart chambers. A first wire assembly 38 extends out of the front of dart chamber 30 through the wire storage chamber in the housing towards the rear of the housing, and terminates in an uninsulated end 40, adjacent the primer case 42. A second wire assembly 44 exits the front of dart chamber 32 and extends rearwardly through the wire storage chamber in the housing and terminates in an uninsulated end 46 at a metal rivet or contact 48 located on a bottom surface 50 of the housing. A conductive contact probe 52 extends through the housing along an upper surface 54 of first portion 14 of the housing. The contact probe terminates at an opening 56 on the front surface 57 of the housing so that the contact probe is exposed. The contact probe runs along the top surface 58 of the rear section 16 of the housing in a slot 60 before extending downwardly along the rear surface of the housing and terminates adjacent the rifle primer 62. A lower conductive contact probe 64 extends through the housing along the first portion 14, adjacent a lower surface 66, and terminates at opening 68 along the front surface 57 of the housing, so that it is also exposed. The opposite end of probe 64 terminates adjacent contact 48. Conductive probes 52 and 64 provide a power source so that the cartridge can deliver an electrical shock to a human target if the darts do not subdue the target and the cartridge is held against the target.

A front plate 68 is positioned over the front of the housing and a rear plate 70 covers the rear surface of the housing. Located between the primer 62 and the dart chambers is backing 72 and a pin 74. When the ammunition cartridge 10 is inserted into recess 18 of the electrical discharge device 20, the conductive contact probe 52 contacts electrode 75 in the electric discharge device 20. Contact 48 contacts the electrically opposed electrode 78 in the electrical discharge device. When the power supply is energized in the weapon, current travels from power supply electrode 75 through the contact probe 52 to primer 62, thereby sparking through the propellant contained in the primer to pin 74. The current then arcs therefrom to the first wire assembly 36 located in dart chamber 30 and travels through the wire assembly to the attached dart. The current arcs therefrom across the exit surface to the second dart assembly and travels through its attached wire assembly 36 until contact 48 and opposed electrode 78 of the power supply or vice versa depending upon the polarity of the supply transformer poles. The propellant contained in the primer detonates and launches the darts from the cartridge. The darts separate from each other in angled flight and open the detonation circuit as its current can no longer complete an arc path between the darts. Once the darts come within arcing distance of a human target, the shocking circuit will complete through and disable the target.

The present invention provides for a longer arc path at the target by lengthening potential arc paths across the exterior surface of the ammunition cartridge and/or ammunition chamber. This is accomplished by placing the ammunition electrical contacts on any two opposed surfaces of the housing. Each contact is placed approximately halfway between the front and rear surfaces to avoid arc breakdowns between an exposed contact and a stored wire conductor. The wire conductor is then routed from one contact to approximately the nearest point of the portion of the primer case exposed on the rear surface of the housing. The rear plate 70 is solid and is adhered to the housing by high dielectric adhesives. Such adhesives can be epoxy or ABS cement having a dielectric strength of 500 to 800 volts per mil, and the rear plate has an inside surface having ridges 71 or other areas of relief or bends to increase the arc track path. Rear plate 70 includes a raised plug 76 halved by a vertical wire slot not shown to seat over and secure the primer 62, which is recessed into the housing to increase the arc track path and limit blowback.

An aperture or depression 80 is placed into or through flange 22 which will cause the flange to bow when the resultant forces cause the stop 25 to collide with wall 82 in recess 27. The resultant bowing of the flange will absorb some of the force. As the aperture deforms, it will cause the sides of the flange to collide with corresponding sides of wall 82, thereby stopping forward progress of the stop towards wall 82. In addition, as the aperture bows, the energy is restored as a spring force, and when released will help to reset the flange within the recess 18 of the electrical discharge weapon. A post 84 extends outwardly from wall 82 for receipt within the aperture 80 to further retain the cartridge within recess 18.

The present invention has been described and illustrated with respect to one embodiment thereof. It is to be understood that the invention is not to be so limited, since changes and modifications can be made therein without departing from the scope of the invention as hereinafter claimed.

What is claimed is:

1. An ammunition cartridge for an electrical discharge weapon comprising:

a housing having an exterior surface and a first dart chamber and a second dart chamber located within the housing;

a first wire tethered dart positioned in the first dart chamber and connected to a first electrical contact;

a second wire tethered dart positioned in the second dart chamber and connected to a second electrical contact;

a primer having a chemical propellant for launching the first and second wire tethered darts;

a contact probe extending from the first electrical contact to a front surface of the ammunition cartridge;

a contact probe extending from the second electrical contact to a front surface of the ammunition cartridge;

the first electrical contact is positioned on a side surface of the housing;

the second electrical contact is positioned on a side surface of the housing opposite the first electrical contact whereby an electrical arc path may cross the exterior surface of the housing.

2. The ammunition cartridge of claim 1, wherein the housing includes a recessed chamber for receipt of the primer.

3. The ammunition cartridge of claim 2, wherein a second wire tethered dart terminates at one of the electrical contacts.

4. The ammunition cartridge of claim 2 further having a back plate with a raised plug for receipt over the primer recessed within the housing.

5. The ammunition cartridge of claim 1, wherein one wire tethered dart terminates adjacent the primer.

6. The ammunition cartridge of claim 1 wherein the dart chambers extend in the housing at an angle to each other.

* * * * *